United States Patent [19]

Rosenberg

[11] Patent Number: 4,832,264

[45] Date of Patent: May 23, 1989

[54] ROTARY SPRINKLERS

[76] Inventor: Peretz Rosenberg, Moshav Beit Shearim, Israel

[21] Appl. No.: 87,369

[22] Filed: Aug. 20, 1987

Related U.S. Application Data

[60] Division of Ser. No. 895,578, Aug. 13, 1986, Pat. No. 4,711,399, which is a continuation of Ser. No. 613,337, Jun. 23, 1984, abandoned.

[30] Foreign Application Priority Data

Jun. 24, 1983 [IL] Israel ..... 69144
Sep. 7, 1983 [IL] Israel ..... 69680

[51] Int. Cl.[4] ..... B05B 3/06

[52] U.S. Cl. ..... 239/222.17; 239/462; 239/499; 239/500; 239/506

[58] Field of Search ..... 239/222.17–222.19, 239/380–382, 498, 499, 500, 501, 506, 512, DIG. 1, 462, 590.3, 590.5

[56] References Cited

U.S. PATENT DOCUMENTS

| | | | |
|---|---|---|---|
| 1,189,068 | 6/1916 | Davis | 239/DIG. 1 |
| 1,881,409 | 10/1932 | Le Moon | 239/DIG. 1 |
| 1,913,278 | 6/1933 | Ivey | 239/DIG. 1 |
| 2,544,176 | 3/1951 | Palmer | 239/590.3 |
| 2,609,238 | 9/1952 | Anderson | 239/462 |
| 2,943,798 | 7/1960 | Rienks | 239/DIG. 1 |
| 2,981,481 | 4/1961 | Hruby, Jr. | 239/462 |
| 3,273,805 | 9/1966 | Hall | 239/590.3 |
| 3,811,620 | 5/1974 | Gebhardt | 239/499 |
| 4,347,981 | 9/1982 | Hayes | 239/DIG. 1 |
| 4,356,974 | 11/1982 | Rosenberg et al. | 239/499 |

FOREIGN PATENT DOCUMENTS

| | | | |
|---|---|---|---|
| 2116456 | 9/1983 | United Kingdom | 239/512 |

*Primary Examiner*—Andres Kashnikow
*Assistant Examiner*—Michael J. Forman
*Attorney, Agent, or Firm*—Benjamin J. Barish

[57] ABSTRACT

A rotary sprinkler comprises a nozzle formed with a bore extending through a face thereof defining an outlet orifice through which the water is to exit as an axially-flowing jet; a jet-impinging member supported close to and in alignment with the orifice so as to be impinged by the axially-flowing jet and to reflect same back towards that nozzle face; and a rotor rotatably mounted between the jet-impinging member and the face of the nozzle. The rotor is formed with a bore for accommodating the axially-flowing jet, and is further formed on its surface facing the jet-impinging member with at least one channel extending generally in the radial direction, effective to constrain the water reflected back towards the nozzle face to form at least one laterally-flowing jet, and to rotate the rotor so as to rotate the laterally-flowing jet.

17 Claims, 2 Drawing Sheets

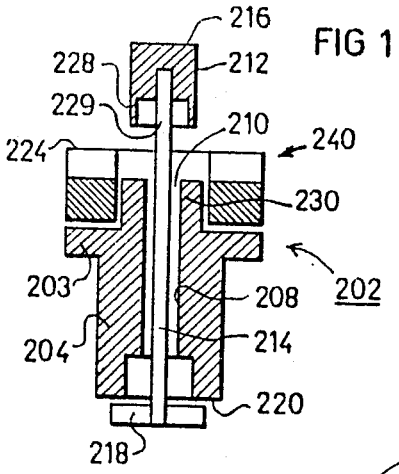
FIG 1
FIG 2
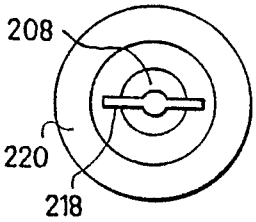
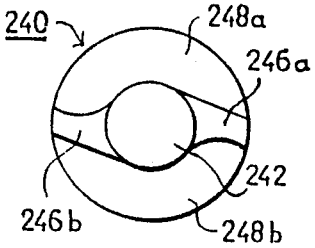
FIG 3
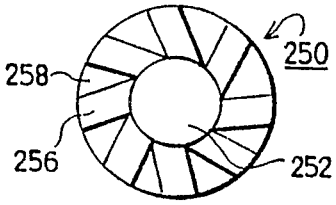
FIG 4
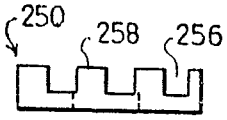
FIG 5
FIG 6
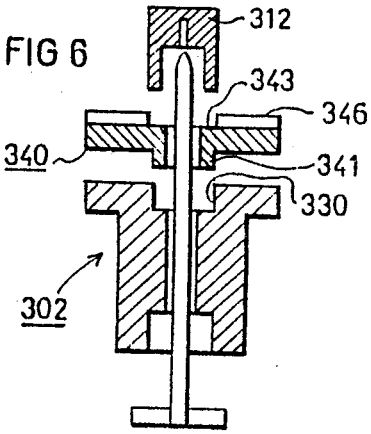
FIG 8
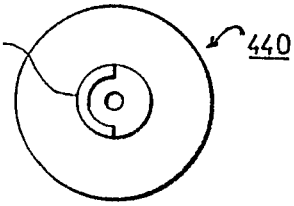
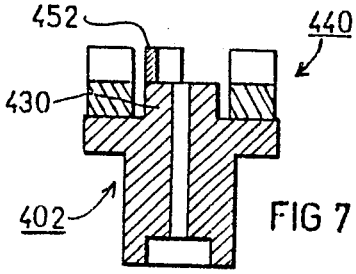
FIG 7

ROTARY SPRINKLERS

RELATED APPLICATIONS

The present application is a division of application Ser. No. 06/895,578 filed 8-13-86 now U.S. Pat. No. 4,711,399, issued Dec. 8, 1987 which in turn is a continuation of application Ser. No. 06/613,337, filed 6-23-84 now abandoned.

BACKGROUND OF THE INVENTION

The present invention relates to spray nozzles, and particularly to spray nozzles useful for water irrigation. The invention is especially useful in the type of spray nozzle of U.S. Pat. No. 4,356,974 and is therefore described below with respect to this application.

U.S. Pat. No. 4,356,974 describes a liquid spraying device particularly useful for water irrigation. It comprises a nozzle formed with an outlet orifice through which the liquid issues in the form of a jet, and a jet-impinging member, in the form of a cup, supported close to and in alignment with the nozzle orifice so as to be impinged by the liquid jet issuing therefrom. During use, the water jet issuing through the nozzle orifice impinges against the end wall of the cup-shaped member, producing a water cushion within the member, which water cushion acts to reflect the water back to the face of the nozzle to produce a relatively uniform distribution of water laterally around the nozzle orifice.

SUMMARY OF THE INVENTION

An object of the present invention is to provide a spray nozzle generally of the foregoing type, but providing a number of improvements in the respects to be described more particularly below.

According to the invention of the present application, there is provided a rotary sprinkler comprising: a nozzle formed with a bore extending through a face thereof defining an outlet orifice through which the water is to exit as an axially-flowing jet; a jet-impinging member supported close to and in alignment with the orifice so as to be impinged by the axially-flowing jet and to reflect same back towards said face of the nozzle; and a rotor rotatably mounted between the jet-impinging member and the face of the nozzle, the rotor being formed with a bore therethrough for accommodating the axially-flowing jet, and being further formed on its surface facing the jet-impinging member with channel means, effective to constrain the water reflected back towards the nozzle face to form at least one laterally-flowing jet, and to rotate the rotor so as to rotate the laterally-flowing jet.

It has been found that spraying devices constructed in accordance with the foregoing features provide a number of important advantages over the previously known spraying devices, particularly those described in U.S. Pat. No. 4,356,974. One important advantage is that by forming the nozzle face with the channels to channel the liquid (water) to form distinct sub-jets, the range of the spraying device is substantially increased, thereby permitting the spraying device to be used with a line pressure even lower than that of the spraying device described in the above-cited patent. This substantially lowers the energy costs, and in some cases even obviates the need for a pump. Moreover, this arrangement also reduces wind and evaporation losses. Further, the channels formed on the face of the nozzle can be used to produce asymmetrical distributions laterally of the spraying device, for example, to provide unwetted zones along an edge or corner of an area to be irrigated. Still further, the devices have a low sensitivity to clogging.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view illustrating one form of rotary water sprinkler constructed in accordance with the present invention;

FIG. 2 is a bottom-plan view of the sprinkler of FIG. 1;

FIG. 3 is a top-plan view illustrating the rotor in the sprinkler of FIGS. 1 and 2;

FIGS. 4 and 5 are top and side views, respectively, illustrating another rotor which may be used;

FIG. 6 is an exploded longitudinal sectional view illustrating another form of rotary sprinkler constructed in accordance with the invention;

FIG. 7 is a longitudinal sectional view illustrating the nozzle and rotor in a further form of rotary sprinkler constructed in accordance with the invention;

FIG. 8 is a top-plan view illustrating the rotor in the sprinkler of FIG. 7;

DESCRIPTION OF PREFERRED EMBODIMENTS

Figure 9:
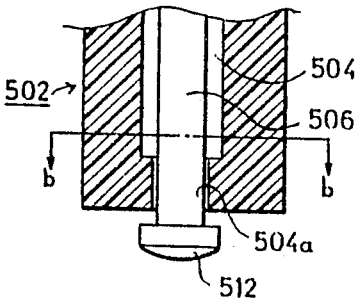
FIG. 9 is a fragmentary sectional view illustrating a modification in the inlet end of the nozzle to prevent clogging.

The sprinkler illustrated in FIGS. 1-3 of the drawings includes a nozzle, generally designated 202, formed with an upper head 203 and a lower conical end 204 for attachment, e.g., by a friction-fit, to a water supply device (not shown). Nozzle 202 is formed with an axial bore 208 communicating at one end (the lower end) with the water supply pipe, and terminating at the opposite end in an outlet orifice 210 through which the water issues in the form of an axially-flowing jet.

A cup-shaped member 212 is supported close to and in alignment with nozzle orifice 210 so as to be impinged by the jet issuing from the orifice. Cup 212 is floatingly mounted by means of a rod 214 passing through nozzle bore 208. Rod 214 is of smaller diameter and of greater length than the nozzle bore, and its outer end is secured by a friction fit centrally of the end wall 216 of cup 212. The opposite end of rod 214 is formed with a crossbar 218 of greater length than the diameter of the respective end of bore 208 so as to limit against the lower face 220 of the nozzle.

It will thus be seen that rod 214 provides a floating mounting for cup 212, permitting the latter to move in a lateral direction with respect to the nozzle orifice 210, and also in an axial direction towards and away from the nozzle orifice. The axially-flowing water jet issuing from orifice 210 flows through the open end of cup 212 and forms a water cushion within it, which cushion reflects the water back towards the upper face 224 of the nozzle. The foregoing structure and operation are clearly described in the above-cited U.S. Pat. No. 4,356,974, wherein it is also brought out that the side wall 229 of cup 212 is very thin, having a thickness which is a small fraction of the diameter of its opening 228.

In U.S. Pat. No. 4,356,974, the surface of the nozzle facing the cup is flat and produces a lateral spray of the water around it. In the present invention, however, a rotor, generally designated 240, is rotatably mounted between cup 212 and the nozzle 202, and is formed on its surface facing the cup with at least one channel effective to constrain the water reflected back from the cup towards the nozzle, to form at least one laterally-flowing jet, and also to rotate the rotor and thereby the laterally-flowing jet. In the arrangement illustrated in FIGS. 1-3, the rotor 240 is formed with two such conduits to produce two laterally-flowing jets which are rotated during the operation of the sprinkler.

More particularly, nozzle 202 is formed with a cylindrical hub 230 on the surface facing cup 212, which hub is of larger outer diameter than the outer diameter of the cup. Rotor 240 is formed with a central bore 242 of a diameter to be rotatably received over hub 230. The upper surface of rotor 240 facing cup 212 is formed with two recessed channels 246*a*, 246*b*, separated by high regions 248*a*, 248*b*, which channels extend generally in the radial direction from bore 242 to the outer surface of the rotor. These channels are not exactly uniform or radial, but rather are larger at their inner ends than at their outer ends, and are given a curvature in the tangential direction, so that when they receive the water reflected back from cup 21, they will apply a rotary motion to the rotor.

The rotary sprinkler illustrated in FIGS. 1-3 operates as follows:

First, when the sprinkler is not operating, cup 212 drops by gravity onto the confronting flat face of the nozzle hub 230, thereby closing orifice 210 and preventing the entry of dirt, insects, or the like.

During operation of the sprinkler, the water flowing through bore 208 of the nozzle exits from orifice 210 in the form of a jet and impinges against cup 212, thereby pushing the cup outwardly until limited by crossbar 218. The impinging jet forms a water cushion within the cup, which water cushion reflects back the water towards nozzle hub 230. The water reflected back to the upper face of hub 230 follows the configuration of that face, which is flat, and therefore moves laterally towards rotor 240. The high regions 248*a*, 248*b*, on the rotor 240 block the flow of the water to these regions and constrain the water to flow through the channels 246*a*, 246*b* of the rotor. Since these channels are wide at their inner ends converging towards their outer ends, and are curved somewhat in the tangential direction, the water flowing through these channels applies a rotary moment to the rotor 240, thereby causing the rotor to rotate on hub 230 of the nozzle.

It will thus be seen that the water issuing from the sprinkler illustrated in FIGS. 1-3 will be in the form of two diametrically-opposed jets which rotate with the rotation of the rotor 240.

FIGS. 4 and 5 illustrate another rotor, therein designated 250, which may be used in the sprinkler of FIGS. 1-3, for producing eight rotating jets, rather than two. Thus, rotor 250 is also formed with a central bore 252 and with eight channels 256 separated by eight high regions 258 symmetrically disposed about the center of the rotor. These channels also progress generally in the radial direction but are turned slightly tangentially in order to apply a rotary moment to the rotor.

It will be appreciated that the rotor could be formed with only one such channel, in which case the sprinkler would produce one rotating laterally-flowing jet, or could include any other number of channels to produce another desired number of jets.

FIG. 6 illustrates another variation wherein the nozzle, therein designated 302, is formed with a cylindrical socket 330 for rotatably supporting the rotor, therein designated 340, the latter being formed with the cylindrical hub 341 rotatably mounted within socket 350. The opposite face of rotor 340 is formed with the channels 346, but in this case the channels do not start at the central bore 342 of the rotor, but rather from points spaced outwardly from the bore so as to provide a flat, unchanneled surface 343 facing the cup 312. Thus, the water reflected back by the water cushion formed within the cup impinges the flat surface 343 of the rotor 340, rather than the flat surface 224 of the nozzle hub 230 in the FIGS. 1-3 arrangement. The water is then constrained by the channels 346 to form the laterally-flowing jets and to apply a rotary moment to the rotor, as in the FIGS. 1-3 arrangement.

FIGS. 7 and 8 illustrate another variation of rotary sprinkler in accordance with the invention. Thus, in the arrangement illustrated in FIGS. 7 and 8, the rotor 440 may be of the same construction as described above with respect to rotor 240 in FIGS. 1-3, but in this case, the hub 430 on nozzle 402, which hub rotatably receives the rotor 440, is shaped so as to produce an asymmetrical distribution of the water to the rotor.

Thus, as shown in FIGS. 7 and 8, hub 430 is formed with a semicircular blocking wall 452 at one side, to block the water from flowing to the respective side of the rotor 440. Semicircular wall 452 is of larger diameter than the opening in the cup (not shown), so that the water reflected back from the cup will impinge the nozzle inwardly of this wall. In such an arrangement, the laterally-flowing jets (or jet) produced by the sprinkler will rotate only for 180°, rather than for 360° in the previously described embodiments. Thus, the rotary sprinkler illustrated in FIGS. 7 and 8 may be used where it is desired to keep one side of the sprinkler unwetted, such as along one edge of a land section to be irrigated.

It will be appreciated that this face of nozzle hub 430 may take other configurations to produce other water distribution patterns, as desired, and that the channels formed in the rotor could be inclined upwardly to incline the laterally-flowing jets.

Figure 10:
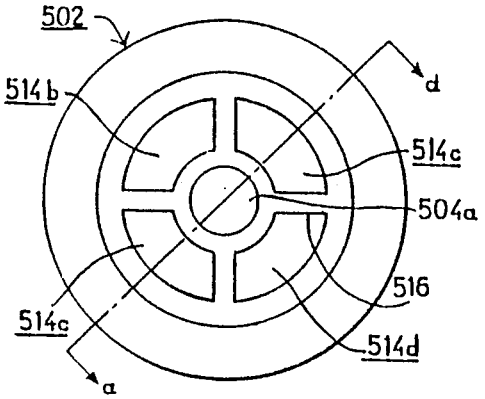
FIG. 10 is a bottom plan view of the modification of FIG. 9.
Figure 12:
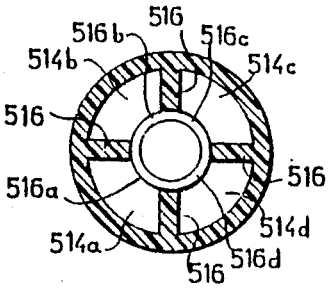
FIG. 12 is a sectional view along lines b—b of FIG. 9 with the spindle removed.
Figure 11:
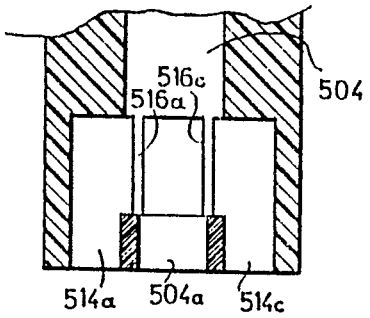
FIG. 11 is a sectional view along lines a—a of FIG. 10.

FIGS. 9-12 illustrate a modification in the inlet end of the nozzle which may be incorporated in any of the above-described devices to lessen the possibility of clogging by foreign particles. These figures illustrate only the lower part of the head or housing wherein the inlet end 504*a* of the bore 504 does not serve as the inlet to the irrigation device, but rather serves merely as a mounting for rod 506. Accordingly, this end 504*a* may be of substantially the same diameter as that of rod 506, preferably slightly larger to permit the rod to freely move axially within the bore. In addition, the respective end of rod 56 is provided with an annular head 512 which is of only slightly larger diameter than that of the rod, sufficient to overlie the edges of bore 504*a* so as to limit the outward movement of the rod.

The inlet into the device is constituted of a plurality of axially-extending inlet bores 514*a*–514*d* formed in the inlet side of housing 502 and disposed laterally of the longitudinal axis of the outlet bore 504, and also laterally of the annular area occupied by head 512 of rod 506 when the latter is inserted within the bore. As shown particularly in FIGS. 10 and 12, these axially-extending inlet bores 514*a*–514*d* are disposed in a circular array around, parallel to, and coaxial with, the longitudinal axis of bore 504, and are separated from each other by thin separator webs 516.

Inlet bores 514*a*–514*d* extend axially through the housing sufficient to underlie the lower end of the enlarged diameter portion of bore 504, but terminate considerably short of the opposite end of the housing, containing the outlet orifice (not shown). Each of these inlet bores 514*a*–514*d* communicates with bore 504*a* by a radially-extending passageway 516*a*–516*d*, respectively.

It will thus be seen that when housing 502 is connected to a pressurized water supply line, as by applying a connector to the outer face of the housing, the water is inletted into the housing, not through bore 504*a*, as in the conventional construction, but rather through the axially-extending blind bores 514*a*–514*d*. The water travels axially through the blind bores, then radially through the passages 516*a*–516*d* to bore 504, and then axially through that bore, issuing from the outlet end 504*b* thereof in the form of an annular jet, as described above.

The illustrated construction, including the four axially-extending inlet bores 514*a*–514*d*, provides a number of important advantages over the conventional construction. Thus, since these inlet bores 514*a*–514*d* have a substantially larger surface area than in the conventional construction (they cover substantially the complete end face of the housing except for the separator webs 516 and the annular rib of the housing), the device has a much lower sensitivity to clogging by foreign particles in the water. Moreover, since the rod head 512 may be of annular configuration, rather than of the crossbar configuration of the conventional construction, and also since this head may have a diameter only slightly greater than the diameter of the rod itself, the rod is permitted to pivot during the operation of the sprinkler along all the axes perpendicular to the rod's longitudinal axis, thereby providing a much improved floating action of the rod and of the cup (not shown) carried thereby, which produces a better distribution of the water around the irrigation device. In addition, the impacting of rod head 512 against the respective face of housing 502 is not concentrated in a restricted area, but rather is distributed around the end face of the housing, thereby extending the useful life of the device.

While the invention has been described with respect to several preferred embodiments, it will be appreciated that many other variations, modifications, and applications of the invention may be made.

What is claimed is:

1. A rotary sprinkler comprising:

a nozzle connectible to a source of pressurized water and formed with a bore extending through a face thereof defining an outlet orifice through which the water is to exit as an axially-flowing jet;

a jet-impinging member, means for supporting said jet-impinging member close to and in alignment with said orifice so as to be impinged by said axially-flowing jet and to reflect same back towards said face of the nozzle;

a rotor, and means for rotatably mounting said rotor between said jet-impinging member and said face of the nozzle, said rotor being formed with a bore therethrough for accommodating said axially-flowing jet, and being further formed on its surface facing the jet-impinging member with channel means, effective to constrain the water reflected back towards said nozzle face to form at least one laterally-flowing jet, and to rotate said rotor so as to rotate said laterally-flowing jet.

2. The sprinkler according to claim 1, wherein the face of the nozzle formed with said outlet orifice is further formed with a projecting cylindrical hub circumscribing said outlet orifice and received in said bore of the rotor for rotatably supporting the rotor.

3. The sprinkler according to claim 2, wherein said hub on the nozzle is formed with a flat surface facing said jet-impinging member and aligned therewith to receive the water reflected back from the jet-impinging member and for deflecting same laterally to said at least one channel formed in the surface of the rotor facing the jet-impinging member.

4. The sprinkler according to claim 2, wherein said hub on the nozzle is formed with a blocking wall at one side to block the water from flowing to the respective side of the rotor, which blocking wall thereby produces an asymmetrical distribution of the water.

5. The sprinkler according to claim 1, wherein the surface of said rotor facing the nozzle is formed with a cylindrical hub rotatably received within a cylindrical socket formed in the surface of the nozzle having said outlet orifice.

6. The sprinkler according to claim 5, wherein the surface of said rotor facing the jet-impinging member includes, in addition to said channel means, a flat surface aligned with said jet-impinging member to receive the water reflected back from the jet-impinging member, thereby deflecting same laterally to said channel means formed in the surface of the rotor facing the jet-impinging member.

7. The sprinkler according to claim 1, wherein said channel means comprises rotor surface facing the jet-impinging member.

8. The sprinkler according to claim 1, wherein said bore formed through said nozzle extends axially of the nozzle and terminates at one end of the outlet orifice, the end of said nozzle opposite to that of the outlet orifice being formed with a plurality of axially-extending inlet bores disposed laterally of the longitudinal axis of the outlet orifice, each of said inlet bores underlying a portion of the outlet orifice but terminating short of the end of the housing formed with said outlet orifice, and communicating with said outlet orifice by a radially-extending passageway therebetween.

9. The sprinkler according to claim 8, wherein said inlet bores are disposed in a circular array around the longitudinal axis of said outlet orifice and are separated from each other by a thin radially-extending web.

10. The sprinkler according to claim 1, wherein said jet-impinging member is cup-shaped and is formed with a circular open end facing the nozzle, said cup-shaped member having a side wall of a thickness which is a fraction of the diameter of its open end and being supported on a rod passing through said bore of the nozzle and of smaller diameter than said bore, the outer end of said rod being attached to the center of the end wall of the cup-shaped member, the inner end of the said rod including a stop limiting the outward movement of the rod and of the cup-shaped member with respect to the nozzle.

11. A water sprinkler comprising:

a housing having an inlet end connectable to a source of pressurized water, and an outlet bore at the end opposite to its inlet end through which the water is discharged;

said inlet end including an axially-extending central inlet bore coaxial with the longitudinal axis of said outlet bore, and a plurality of axially-extending lateral inlet bores disposed laterally around, parallel to, and coaxial with, the longitudinal axis of the central inlet bore and the outlet bore;

each of said inlet bores underlying a portion of the outlet bore but terminating short of said opposite end of the housing;

each of said inlet bores communicating with said outlet bore by a radially-extending passageway therebetween;

and a rod extending through said central inlet bore and having a length larger than the distance between said central inlet bore and said outlet bore, said rod being of smaller diameter than that of said central inlet bore and said outlet bore, so that the rod is movable both laterally and axially with respect to said bores; the end of said rod adjacent said central inlet bore including a head aligned with said central inlet bore but uncovering said plurality of lateral inlet bores;

the end of said rod adjacent the outlet bore carrying a jet-impinging member close to and in alignment with said outlet bore so as to be impinged by the jet discharged therefrom.

12. The sprinkler according to claim 11, wherein said inlet bores are disposed in a circular array around said longitudinal axis of the outlet bore.

13. The sprinkler according to claim 11, wherein said inlet bores are separated from each other by thin radially-extending webs.

14. The sprinkler according to claim 11, wherein said jet-impinging member impinged by the water jet discharge from the outlet bore reflects the water jet back towards the face of the housing;

said sprinkler further including a rotor rotatably mounted between said jet-impinging member and said face of the housing, said rotor being formed with a bore therethrough for accommodating said rod and said water jet, and being further formed on its surface facing the jet-impinging member with channel means, effective to constrain the water reflected back towards said housing face to form at least one laterally-flowing jet, and to rotate said rotor so as to rotate said laterally-flowing jet.

15. The sprinkler according to claim 14, wherein the face of the housing formed with said outlet bore is further formed with a projecting cylindrical hub circumscribing said outlet bore and received in said bore of the rotor for rotatably supporting the rotor.

16. The sprinkler according to claim 14, wherein the surface of said rotor facing the housing is formed with a cylindrical hub rotatably received within a cylindrical socket formed in the surface of the housing having said outlet bore.

17. The sprinkler according to claim 14, wherein said jet-impinging member is cup-shaped and is formed with a circular open end facing the nozzle, said cup-shaped member having a side wall of a thickness which is a fraction of the diameter of its open end and being supported on a rod passing through, and of smaller diameter than, said bore in the nozzle, the outlet end of said rod being attached to the center of the end wall of the cup-shaped member, the inner end of said rod including a stop limiting the outward movement of the rod and the cup-shaped member with respect to the housing.

* * * * *